US010840046B2

(12) United States Patent
Delbaere et al.

(10) Patent No.: US 10,840,046 B2
(45) Date of Patent: Nov. 17, 2020

(54) ELECTRICAL DEVICE FOR SUPPLYING ELECTRICAL POWER TO ELECTRICAL POWER UNITS

(71) Applicant: Schneider Electric Industries SAS, Rueil-Malmaison (FR)

(72) Inventors: Stephane Delbaere, Grenoble (FR); Gilles Baurand, Montesson (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 301 days.

(21) Appl. No.: 16/038,220

(22) Filed: Jul. 18, 2018

(65) Prior Publication Data

US 2019/0035589 A1 Jan. 31, 2019

(30) Foreign Application Priority Data

Jul. 25, 2017 (FR) ..... 17 57041

(51) Int. Cl.
*H01H 71/12* (2006.01)
*H01H 71/02* (2006.01)
(Continued)

(52) U.S. Cl.
CPC ..... *H01H 71/123* (2013.01); *H01H 71/0228* (2013.01); *H01H 89/06* (2013.01);
(Continued)

(58) Field of Classification Search
CPC .. H01H 71/123; H01H 71/0228; H01H 89/06; H01H 89/08; H01H 2071/006; H01H 2089/065; H01R 9/2658
See application file for complete search history.

(56) References Cited

U.S. PATENT DOCUMENTS 5,493,194 A * 2/1996 Damiano ..... G05B 19/414 307/71
6,833,996 B2 * 12/2004 Haworth ..... G06F 1/184 361/730

(Continued)

FOREIGN PATENT DOCUMENTS

EP 2 015 341 A1 1/2009
EP 2 202 848 A1 6/2010
FR 2 761 539 A1 10/1998

OTHER PUBLICATIONS

French Preliminary Search Report dated Jun. 8, 2018 in French Application 17 57041, filed on Jul. 25, 2017 ( with English translation of Categories of Cited Documents and Written Opinion).

*Primary Examiner* — Jeffrey A Gblende
*Assistant Examiner* — Lakaisha Jackson
(74) *Attorney, Agent, or Firm* — Oblon, McClelland, Maier & Neustadt, L.L.P.

(57) ABSTRACT

An electrical device for supplying electrical power to multiple power units includes a first module, including an electrical circuit breaker; a second, removable module, including a control circuit, programmed to trip the circuit breaker depending on values of the electric current that is flowing through power lines; a connection interface provided with output connectors that are connected to the power lines; removable elements, each containing an item of electrical equipment that is intended to be connected to an electrical power unit and to one of the power lines by the output connectors, the control circuit being connected to an interface for controlling each removable element via a data link by virtue of the connection interface.

10 Claims, 6 Drawing Sheets

(51) Int. Cl.

| | |
|---|---|
| ***H01H 89/06*** | (2006.01) |
| ***H01R 9/26*** | (2006.01) |
| *H01H 89/08* | (2006.01) |
| *H01H 71/00* | (2006.01) |

(52) U.S. Cl.
CPC ..... *H01R 9/2658* (2013.01); *H01H 89/08* (2013.01); *H01H 2071/006* (2013.01); *H01H 2089/065* (2013.01)

(56) References Cited

U.S. PATENT DOCUMENTS

| | | | | |
|---|---|---|---|---|
| 7,271,506 | B1 * | 9/2007 | Bersiek | H02B 1/24 307/125 |
| 2003/0016103 | A1 * | 1/2003 | Haudry | H01H 83/04 335/9 |
| 2009/0040673 | A1 | 2/2009 | Maigret et al. | |
| 2013/0019124 | A1 * | 1/2013 | Grimshaw | H05K 7/1497 714/24 |
| 2013/0342968 | A1 * | 12/2013 | Peterson | H05K 1/141 361/622 |

* cited by examiner

ELECTRICAL DEVICE FOR SUPPLYING ELECTRICAL POWER TO ELECTRICAL POWER UNITS

The present invention relates to an electrical device for supplying electrical power to electrical power units.

In the field of supplying electrical power to electrical power units, such as electric motors, it is known for electrical devices to be used that allow a controlled supply of electrical power to be provided for one or more power units. For example, multiple electric motors are connected to such an electrical device in order to form an assembly called motor starter. This device is configured to receive an electric power supply current and to redistribute said current to multiple power supply lines each connected to one of the electric motors. This device allows electrical protection to be provided for each of the motors, for example, by means of a circuit breaker, as well allows each of these motors to be controlled, for example, by allowing selective interruption of the current that is flowing through the power lines. An example of such an electrical device is disclosed in EP-1318537-B1.

However, this known device is not entirely satisfactory given contemporary uses, particularly due to limited operating flexibility. Any modification of the motor starter assembly in order to add a functionality requires complete modification of the device, which is restrictive.

It is these disadvantages that the invention more specifically intends to overcome by proposing an electrical device for supplying electrical power to multiple electrical power units that overcomes the aforementioned disadvantages.

To this end, the invention relates to an electrical device for supplying electrical power to multiple power units. This device comprises:

- a fixed support;
- input terminals for receiving a polyphase electric current;
- a first module comprising a first power line connected to the input terminals, said power line comprising an electrical circuit breaker;
- a second removable module comprising:
  - second power lines connected to the first power line via an electrical distribution circuit configured to distribute the polyphase electric current from the first power line to each of the second power lines;
  - a control circuit programmed to trip the circuit breaker depending on values of the electric current that is flowing through the second power lines;
  - a connection interface provided with output connectors connected to the second power lines;
- removable elements each containing an item of electrical equipment intended to be connected to an electrical power unit via output terminals of said removable elements, each removable element being movable between an assembled position, in which it is connected to the connection interface, and a removed position, in which it is removed from the connection interface, the electrical equipment being connected to one of the second power lines via the output connectors of the connection interface when the removable element is in the assembled position, the control circuit being connected to a control interface of the electrical equipment of each removable element via a data link by virtue of the connection interface in order to send a control signal to said electrical equipment.

By virtue of the invention, the modular design of the electrical device, particularly by virtue of the first and second modules and of the removable elements, allows each function of the electrical device to be isolated in a dedicated module and/or removable element. This allows part of the electrical device to be replaced independently of the other parts, through the simple extraction of the removable module or the removable element, for example, during maintenance operations for replacing a faulty element or for replacing an element when new functionalities need to be added, for example.

According to advantageous but non-mandatory aspects of the invention, such an electrical device can incorporate one or more of the following features, taken separately or according to any technically permissible combination:

- the controllable electrical element is a contactor with separable contacts adapted to selectively interrupt the flow of an electric current on the second power line to which it is connected;
- the controllable electrical element is a direction or rotation inverter or a data input/output module;
- the connection interface comprises housings each intended to receive a connection portion of one of the removable elements when said removable element is in the assembled position;
- the second module is connected to a data bus and the control circuit is programmed to send a control signal depending on control orders received from the data bus;
- each removable element comprises a data input terminal for receiving a control order, said data input terminal being connected to a first link part, and the second module comprises a second link part connected to the control unit;
- the connection portion of each removable element comprises connectors, the shape of which matches that of the output connectors and which are formed so as to project relative to the connection portion, the electrical connection between the electrical equipment and the corresponding second power unit being provided via said connectors;
- the connection interface and the connection portion of each removable element comprises translation movement guidance devices with matching shapes in relation to each other in order to enable a translation movement of this removable element relative to the second module;
- the first module comprises an additional contactor connected to the first power line and adapted to be controlled by the control circuit;
- the first module is removable.

The invention will be better understood, and further advantages thereof will become more clearly apparent, in the light of the following description of an embodiment of an electrical device, which is provided solely by way of an example, and with reference to the accompanying drawings, wherein.

Figure 1:
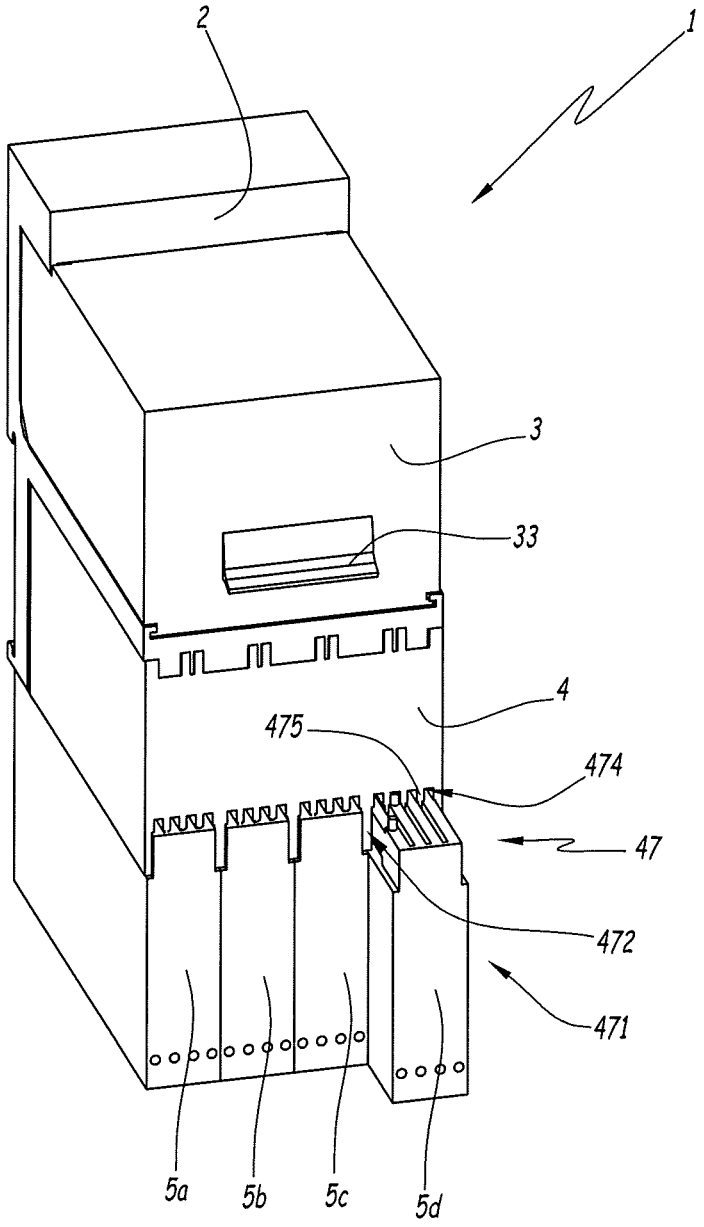
FIG. 1 is a schematic representation of an electrical device according to the invention.
Figure 2:
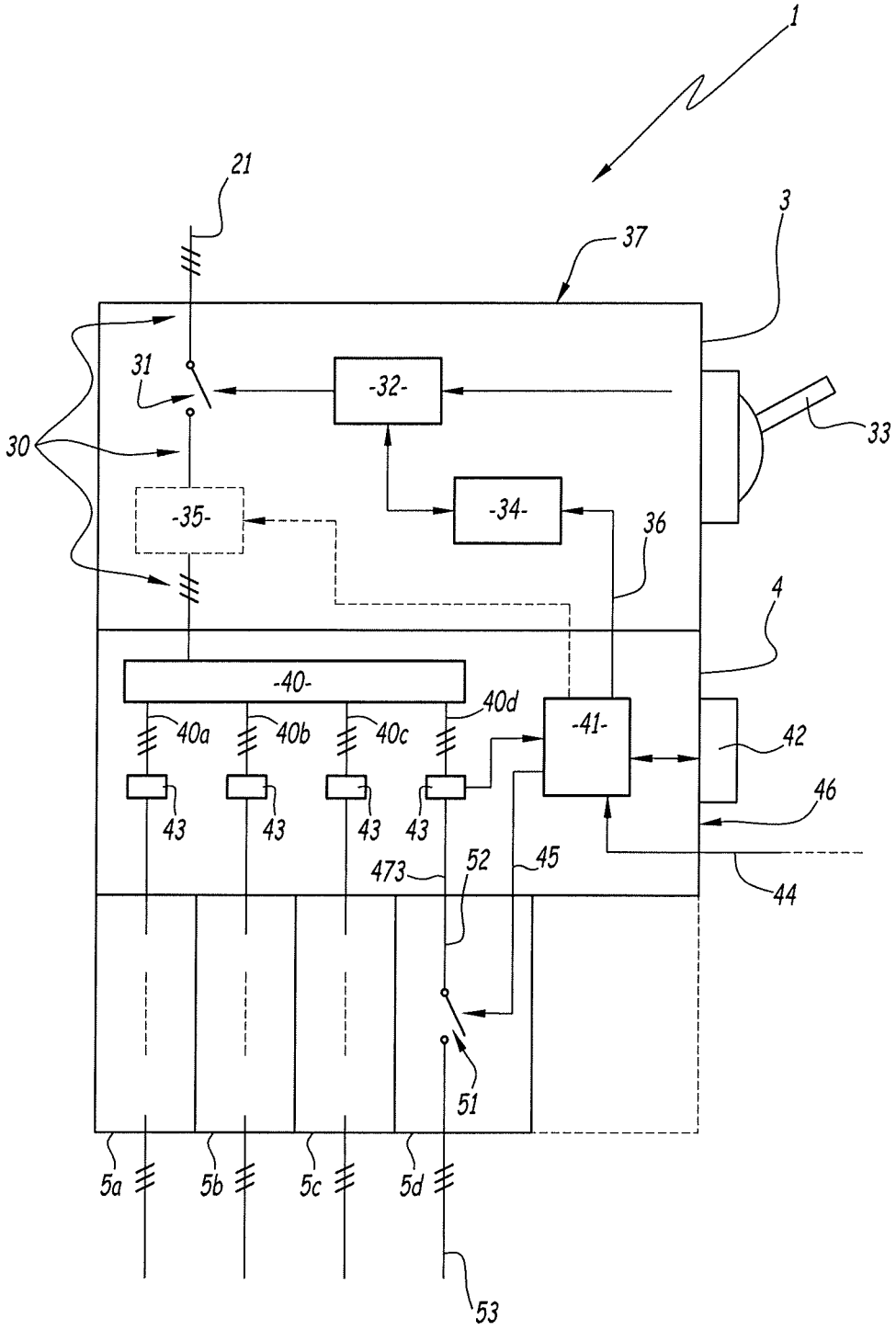
FIG. 2 is a block diagram of the electrical device of FIG. 1.

FIGS. 1 and 2 show an electrical device 1 for controlling the electrical power supply of electrical power units, such as electric motors. In this case, the device 1 comprises an electrical power supply input and multiple electrical power supply outputs, between which an electrical power supply current is redistributed that is received on the power supply input. The power supply outputs are each connected to a power unit for electrically supplying said unit with power whilst ensuring, on the one hand, protection against electrical faults and, on the other hand, permitting selective interruption of the electrical power supply of each of said power units.

For example, the device 1 is used within a motor starter assembly to control the electrical power supply of multiple alternative current electric motors.

The device 1 comprises a fixed support 2, or base, as well as a first module 3, a second removable module 4 and removable elements 5*a*, 5*b*, 5*c* and 5*d*, in this case four removable elements. In this case, the fixed support 2 is placed behind the device 1 and is installed inside an electrical panel or an electrical cabinet.

In this example, the first module 3 is removable, i.e. it can be reversibly separated from the fixed support 2. By way of a variation, the first module 3 can be attached to the fixed support 2 in a non-detachable manner.

The device 1 further comprises input terminals 21 for receiving a polyphase electric current, such as a three-phase current, intended to supply the electric motors. The input terminals 21 are, for example, connected to an electrical power supply source outside the device 1. For example, for a three-phase electric current, the input terminals 21 are formed by three distinct electrical conductors, each associated with a phase of the electric current.

In this case, the input terminals 21 are disposed at least partially inside the fixed support 2. By way of a variation, however, other arrangements are possible, for example, by disposing the input terminals 21 in the first module 3.

The purpose of the first module 3, for example, called protection module, is to protect the device 1 and the power units against electrical faults, such as a short-circuit or an overload current. To this end, it comprises a first power line 30 and a controllable circuit breaker 31.

The power line 30 is intended to be electrically connected to the terminals 21 in order to enable the flow of the polyphase electric current. For example, the power line 30 comprises three distinct electrical conductors. The circuit breaker 31 is connected to the power line 30 so as to allow the electric current to be interrupted on this power line 30.

In this case, the circuit breaker 31 comprises separable electrical contacts, for example, one for each conductor of the power line 30. The circuit breaker 31 is, in a known manner, switchable between a closed state allowing the current to pass through the power line 30 and an open state, in which it prevents the passage of the current. This circuit breaker 31 is preferably equipped with an arc extinguishing chamber associated with said separable contacts.

In this example, the first module 3 also comprises a mechanism 32 for controlling the circuit breaker 31, a component 33 for manually controlling the circuit breaker 31 and a tripping device 34.

In this case, the control component 33 is a lever, or pin, placed on an outer face of the casing of the module 3 so as to be able to be manually activated by an operator. By way of a variation, the component 33 comprises a rotary handle.

The purpose of the tripping device 34 is to automatically activate the control mechanism 32 to open the circuit breaker 31, particularly if a thermal overload or short-circuit fault is detected.

Furthermore, the circuit breaker 31 in this case is connected to the second module 4 via a data link 36, as described hereafter.

The first module 3 is reversibly movable between an assembled position, in which it is mounted on the support 2, rigidly connected thereto, and a removed position, in which it is separated from the support 2. For example, the support 2 comprises a first housing, the shape of which matches that of the first module 3, inside which housing this first module 3 is received when it is in the assembled position.

By way of an example, the movement between the assembled and removed positions involves a translation movement, preferably in a direction perpendicular to the bottom of the support 2. To this end, the support 2 and the first module 3 comprise matching shaped translation movement guidance means.

In the assembled position, the power line 30 is connected to the input terminals 21. For example, each of the conductors of the power line 30 is electrically connected to a corresponding terminal 21. In the removed position, the power line 30 is disconnected from the input terminals 21.

For example, the first module 3 comprises an outer casing 37 made of an insulating material, such as a moulded plastic material. This casing 37 is preferably provided with fixing components that allow the module 3 to be rigidly connected to the support 2 in the assembled position.

By way of an illustration, the first module 3 is in the shape of a parallelepiped-based block. The width L1 of the first module 3, measured on a front face of the first module 3, in this case is 45 mm. The front face in this case is the face of the module 3 that is disposed opposite the rear face located in contact with the support 2.

Preferably, the movement of the first module 3 between the assembled and removed positions can only be performed when no electric current is flowing through the device 1, for example, by virtue of locking means, the status of which depends on the status of the circuit breaker 31.

Optionally, the first module 3 comprises a controllable contactor 35 mounted on the power line 30, the purpose of which is described hereafter.

The purpose of the second module 4, called control module herein, is to control and monitor the device 1. It also allows distribution to be provided for the electric current received from the first module 3 so that it can be routed to the power units. For example, the second module 4 is placed below the first module 3.

To this end, the second module 4 comprises an electrical distribution circuit 40 and second power lines 40*a*, 40*b*, 40*c*, 40*d* connected to this distribution circuit 40. The distribution circuit 40 is intended to be connected to the first power line 30 in order to distribute the polyphase current to each of the second power lines 40*a*, 40*b*, 40*c*, 40*d*.

In this example, each of the second power lines 40*a*, 40*b*, 40*c*, 40*d* comprises distinct electrical conductors each associated with a phase of the electric current. The second power lines 40*a*, 40*b*, 40*c*, 40*d* in this case are identical to each other. The second power lines 40*a*, 40*b*, 40*c*, 40*d* are adapted to each route an electrical power supply current from the circuit 40 to a corresponding electrical device upstream of the device 1.

The connection between the first power line 30 and the distribution circuit 40 is provided, for example, by virtue of fixed intermediate terminals, not shown, belonging to the support 2. These intermediate terminals comprise, for example, multiple distinct electrical conductors, in this case three conductors, each associated with a phase of the electric current.

The second module 4 is reversibly movable between an assembled position, in which it is mounted on the support 2, rigidly connected thereto, and a removed position, in which it is separated from the support 2. For example, the support 2 comprises a second housing, which is distinct from the first housing and the shape of which matches that of the second module 4, in which housing this second module 4 is received when it is in the assembled position.

By way of an example, the movement between the assembled and removed positions involves a translation movement, in this case in a direction perpendicular to the bottom of the support 2, similar to the movement of the first module 3. To this end, the support 2 and the second module 4 comprise mutually matching translation movement guidance means.

In the assembled position, the distribution circuit 40 is connected to the intermediate terminals of the support 2. For example, each of the conductors of the power line 30 is electrically connected to a corresponding intermediate terminal of the support 2. In the removed position, the distribution circuit 40 is disconnected from the intermediate terminals.

In this case, it is understood that the distribution circuit 40 is connected to the first power line 30, and thus to the input terminals 21, only when the first module 3 and the second module 4 are both in their assembled positions.

By way of a variation, the distribution circuit 40 is not necessarily located in the second module 4. For example, the distribution circuit 40 is housed in the first module 3 or in the fixed support 2.

In this example, the second module 4 comprises an outer casing 46 made of an insulating material, such as a moulded plastic material, in this case similar to the casing 37 of the first module 3. This casing 46 is preferably provided with fixing components that allow the module 4 to be fixed on the support 2 in the assembled position.

By way of an illustration, the second module 4 is in the shape of a parallelepiped-based block. The width L2 of the second module 4, measured on a front face of this module 4, in this case is identical to that of the first module 3, and is thus 45 mm.

The second module 4 comprises a control circuit 41 for controlling the operation of the device 1 and, in this case, for authorising remote control. The control circuit 41 also provides measurement and protection functions.

In this example, the control circuit 41 comprises an electronic circuit including an electronic computer, such as a microprocessor or a programmable microcontroller, as well as an information storage medium, such as a non-volatile data memory, for example, using FLASH technology, for storing configuration values and/or executable instructions in order to operate the control circuit 41.

The control circuit 41 also comprises a data exchange interface adapted to be connected to an external data link, for example, for receiving a control order and/or for transmitting measured data.

In this example, the module 4 is connected to a wired data bus 44, such as a field bus. The data exchange interface of the control circuit 41 is thus connected to this data bus 44.

Figure 5:
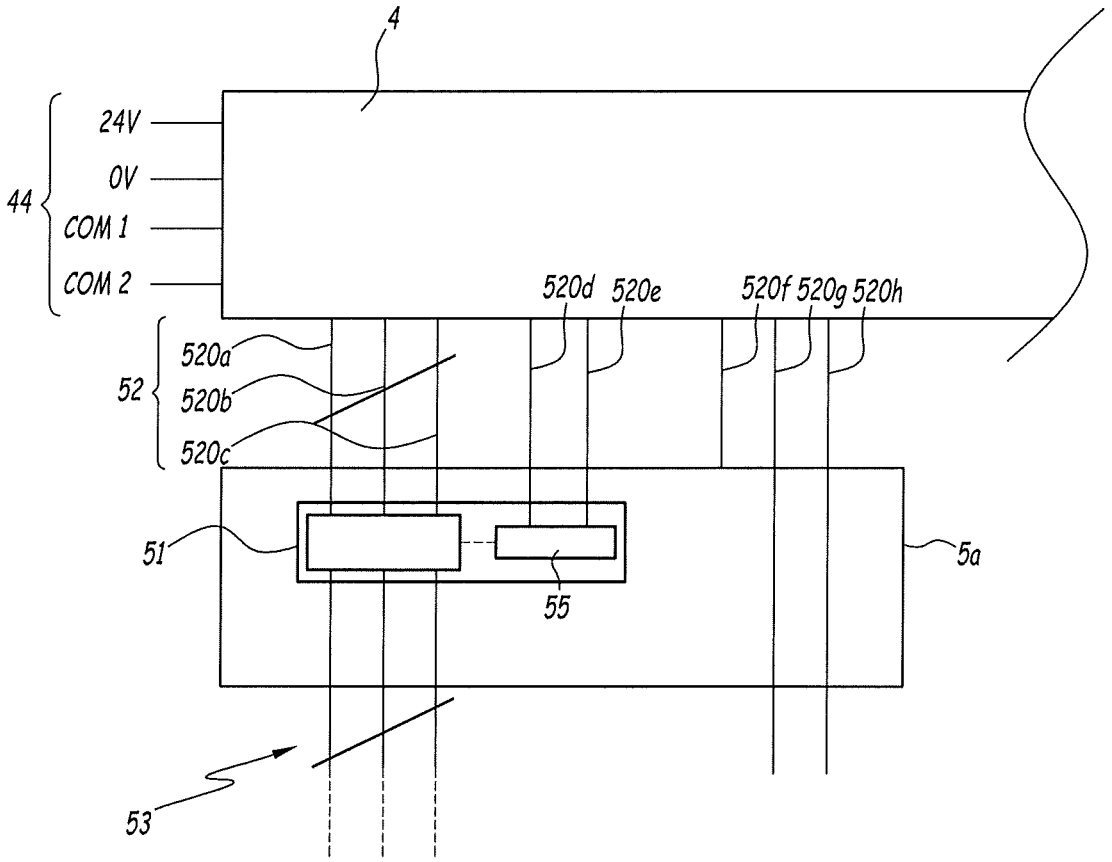
FIGS. 5 and 6 are simplified diagrams of a connection between a control module and a removable element of the electrical device according to the embodiment of FIGS. 2 and 4, respectively.

By way of an example, the data bus 44 in this case comprises four conductors 24V, 0V, COM1 and COM2 each associated with an electrical signal (FIG. 5).

In particular, the control circuit 41 in this case is programmed to trip the opening of the circuit breaker 31 depending on values of the electric current that is flowing through the second power lines 40*a*, 40*b*, 40*c*, 40*d*, for example, when the intensity of the electric current flowing through one of the second power lines 40*a*, 40*b*, 40*c*, 40*d* exceeds a predefined threshold.

To this end, the second module 4 comprises current sensors 43 each associated with one of the second power lines 40*a*, 40*b*, 40*c*, 40*d*, each sensor 43 in this case being adapted to measure the current that is flowing through each of the phases of this power line. For example, each sensor 43 comprises current sensors of the Rogowski type. The sensors 43 are connected to a data acquisition interface of the control circuit 41.

In this case, the control circuit 41 is connected to the tripping device 34 via the data link 36. This link 36 is a wired link, for example, formed by associating two distinct parts, respectively belonging to the modules 3 and 4, and connected together by a suitable connector, in this case borne by the support 2, which connects these two distinct parts when the modules 3 and 4 are both in their assembled position.

The second module 4 also comprises a control interface 42 connected to the circuit 41 and disposed on an outer face of the module 4 to allow an operator to configure the operation of the control circuit 41, for example, to select the aforementioned current threshold value for tripping the circuit breaker 41.

For example, the interface 42 comprises one or more rotary selection knobs, intended to be used by an operator to select one or more current threshold values.

By way of a variation, the interface 42 can comprise a digital human-machine interface, including, for example, a display screen, which is electronic, for example, and selection knobs.

The control circuit 41 advantageously is also programmed to provide other functions, for example, for diagnostics and/or for monitoring the operation of the device 1. For example, the control circuit 41 gathers measured electrical values such as the electric voltage between the phases of a power line and/or the electrical power passing through each power line.

Furthermore, the control circuit 41 is programmed to control the operation of the modules 5*a*, 5*b*, 5*c* and 5*d* by sending a control signal, as described hereafter. This control in this case is carried out by means of data links 45, each connecting one of the removable elements 5*a*, 5*b*, 5*c* and 5*d* to the control circuit 41. For example, the control signal is an electric voltage. The link 45 then comprises two electrical conductors, between which the corresponding electric voltage is applied.

The removable elements 5*a*, 5*b*, 5*c* and 5*d*, also called removable cartridges, each contain a controllable item of electrical equipment. Each of these items of electrical equipment is intended to be connected to one of the second power lines 40*a*, 40*b*, 40*c* and 40*d*, for example, with a view to acting on the operation of the electrical power units supplied by these power lines. For example, the removable elements 5*a*, 5*b*, 5*c* and 5*d* are placed below the second module 4.

Figure 3:
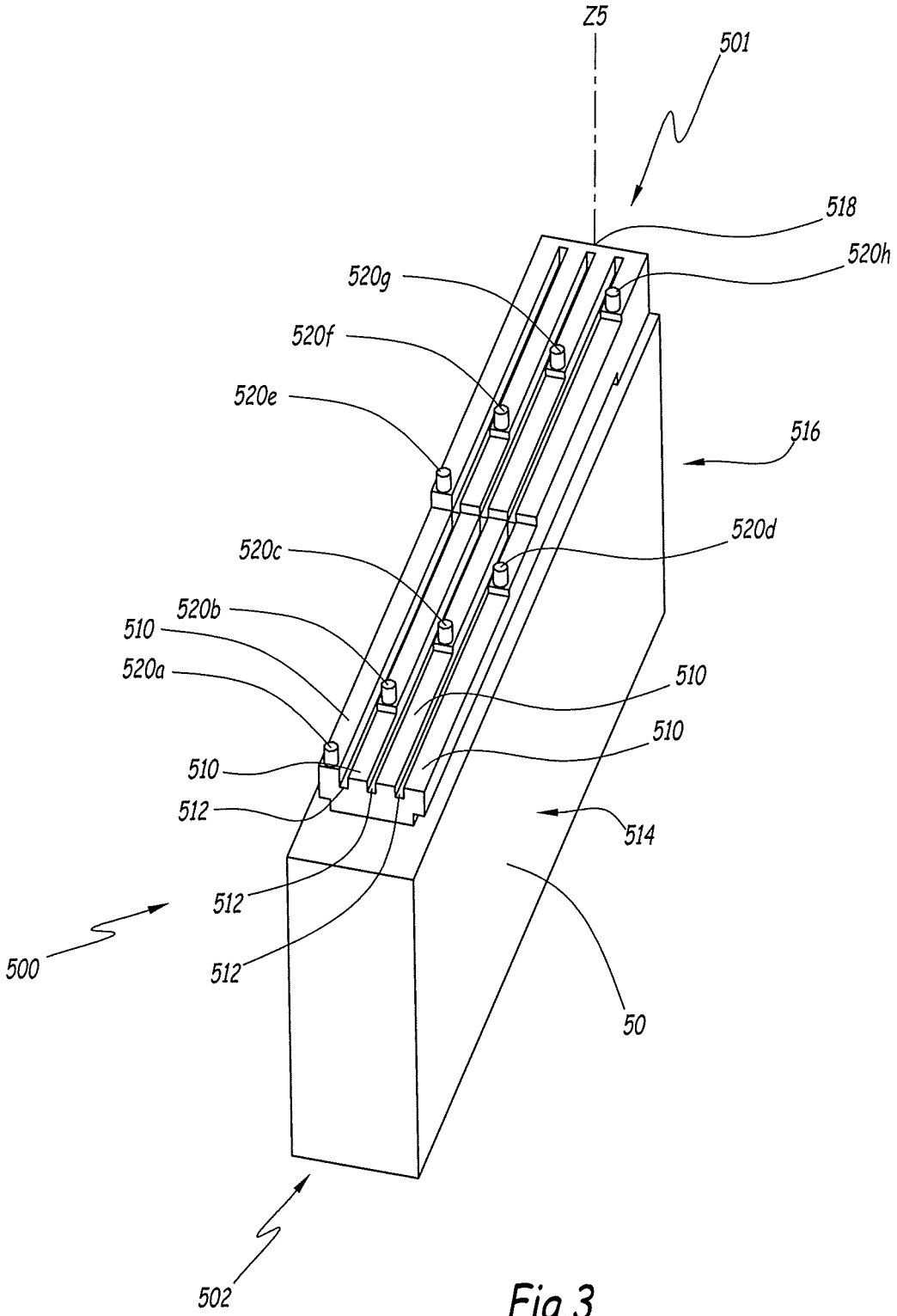
FIG. 3 is a schematic representation of a removable element of the electrical device of FIGS. 1 and 2.

In this example, the removable elements 5*a*, 5*b*, 5*c* and 5*d* are identical. Furthermore, only one of said removable elements, in this case the element 5*d*, is shown in FIGS. 2 and 3.

In this example, the items of electrical equipment contained in the removable elements 5*a*, 5*b*, 5*c* and 5*d* are controllable contactors 51. Each contactor 51 thus comprises separable electrical contacts and a control interface 55, such as a controllable electromagnet actuator.

The separable contacts of each contactor 51 are electrically connected to the conductors of the corresponding second power line 40*a*, 40*b*, 40*c* and 40*d* by means of a power link 52, described hereafter, when the removable element is in the assembled position.

Each contactor 51 is switchable between an open state and a closed state in order to respectively prevent or allow the flow of an electric current from said second power line to the corresponding electrical device. This switching is independent of that of the circuit breaker 31. More specifically, the switching of each contactor 51 is provided by virtue of the corresponding actuator, in response to a control signal, in this case supplied by the control circuit 41 through the link 45.

In this way, by virtue of these contactors 51, the supply of one or more of the electrical power device(s) connected downstream of the device 1 can be selectively interrupted.

Thus, in this embodiment, the control signal for opening or closing a contactor 51 is sent by the control circuit 41, in response to a corresponding control order received by virtue of the data bus 44.

As shown in FIG. 3, each removable element 5*a*, 5*b*, 5*c* and 5*d* comprises a casing 50, inside which the controllable electrical equipment is housed. This casing 50 is, for example, made of a material similar to that of the casing 37 and/or of the casing 46. Reference numeral "501" denotes a front face and reference numeral "502" denotes a rear face of this removable element 5*d*. This casing 50 in this case comprises a block shape, the width L3 of which, measured on a base of the front face of this removable element 5*d*, equals a quarter of the width L2 of the second module 4. The casing 50 in this case is superposed by a connection portion 500, forming a connection interface with the second module 4, also called interface 500 hereafter.

The removable elements 5*a*, 5*b*, 5*c* and 5*d* each contain a connection interface, for example, located on a base of the casing 50, containing output terminals 53 that are intended to electrically connect the controllable electrical equipment to the corresponding electrical device.

The removable elements 5*a*, 5*b*, 5*c* and 5*d* are intended to be removably associated with the second module 4. To this end, the second module 4 comprises a connection interface 47 for the removable elements 5*a*, 5*b*, 5*c* and 5*d*. The interfaces 47 and 500 also provide a mechanical connection and an electrical connection between the second module 4 and the corresponding removable element.

In this example, the interface 47 comprises multiple housings 471, at least partly delimited by partition walls 472, for example, formed integral with the casing 46. In this case, there are four housings 471 and they are identical to each other.

Each removable element 5*a*, 5*b*, 5*c* and 5*d* is reversibly movable between an assembled position, in which it is received in a housing 471, and a removed position, in which it is separated from its housing 471.

By way of an example, the movement between the assembled and removed positions involves a translation movement, in this case in a direction, called direction of movement, perpendicular to the bottom of the support 2, preferably in a similar way to the movement of the modules 3 and 4. In FIG. 1, the elements 5*a*, 5*b* and 5*c* are shown in their assembled positions, whereas the element 5*d* is shown partially removed from the housing 471.

The interface 47 comprises a translation movement guidance device, in this case including grooves 474 that extend in the direction of movement. These grooves 474 in this case are identical and parallel to each other. The grooves 474 are separated from each other by tongues 475, which in this case extend vertically. The grooves 474 are preferably arranged in a lower zone of the second module 4. The grooves 474 in this case extend longitudinally between the rear and front faces of the module 4, perpendicular to these rear and front faces and emerge on the front face of the second module 4. The grooves 474 in this case define a castellated profile in a transverse section parallel to the front face of the module 4.

Additionally, the interface 500 of each removable element 5*a*, 5*b*, 5*c* and 5*d* comprises longitudinal and parallel walls 510, which extend by projecting relative to an outer face and along a vertical axis Z5 of this removable element 5*a*, 5*b*, 5*c* and 5*d*. These walls 510 delimit recesses 512, which are also longitudinal and parallel and which are separated from each other by the walls 510, thus forming a guidance device intended to cooperate with the grooves 474 and the tongues 475 to allow the translation movement.

As shown in FIG. 1, when the interface 500 cooperates with the interface 47, the tongues 475 penetrate inside the recesses 512. The walls 510, for their part, are received in the grooves 474.

In this example, the interface 500 contains three grooves 512 and four walls 510.

The clearance between the recesses 512 and the tongues 475 is selected so as to allow the translation movement of the removable element 5*a*, 5*b*, 5*c* and 5*d* relative to the module 4.

In this example, the interface 500 comprises a first zone 514 and a second zone 516 adjacent to each other in the direction of the length of the removable element 5*a*, 5*b*, 5*c* and 5*d*. The zone 516 in this case is on the side of the front face 501, whereas the zone 514 in this case is on the side of the rear face 502. The walls 510 each extend in the zones 514 and 516 and have an elevated portion parallel to the axis Z5 in the zone 516. The interfaces 47 and 500 also allow an electrical connection to be provided between the second module 4 and the electrical equipment of the corresponding removable element 5*a*, 5*b*, 5*c* and 5*d*, so as to allow the electric power supply current to flow via a power link 52 and data to be exchanged via the link 45.

To this end, the interface 47 comprises power output connectors 473 connected to the second power lines 40*a*, 40*b*, 40*c* and 40*d*. In this example, the interface 47 comprises multiple connectors 473 of this type, with each one being connected to a conductor of a second power line 40*a*, 40*b*, 40*c* and 40*d*. These connectors 473 are only schematically shown in FIG. 2.

The interface 500 comprises connectors 520, in this case in the form of metal pads and which are preferably identical to each other. These connectors extend by projecting relative to an upper face of the interface 500, in this case each one extends from the upper face of a wall 510. These connectors 520 are distributed in an offset manner in the direction of movement, so that two connectors placed on immediately neighbouring walls 510 are not too close to each other. For example, the distance between the centres of two immediately neighbouring conductors 520 is strictly greater than the distance between the two walls 510 on which these conductors 520 are arranged. The connectors 473 and 45 are preferably correspondingly disposed on the interface 47.

In this example, each interface 500 comprises eight connectors 520, denoted 520*a* to 520*f*.

As shown in FIG. 5, the connectors 520*a*, 520*b* and 520*c* in this case are each associated with an electric phase and thus form the power link 52 intended to be connected to the corresponding second power line 40*a*, 40*b*, 40*c* and 40*d* of the second module 4 in order to provide a flow of the power supply current to this movable element. Thus, the connectors 520*a*, 520*b* and 520*c* are connected to an input of the corresponding electrical element 51 and are intended to be connected to the connectors 473 of one of the second power lines.

The connectors 520*a*, 520*b* and 520*c* in this case are preferably grouped towards the rear of the removable element, so as to prevent them from being accidentally accessed by a user of the device 1.

The connectors 520*d*, 520*e*, 520*f*, 520*g* and 520*h* in this case are used to transfer data and/or are inactive and are particularly used to form the link 45.

For example, the connectors 520*d* and 520*e* are connected to the control interface 55 of the corresponding removable element and are intended to be connected to the connectors of the data link 45 in order to enable the transmission of the control signal transmitted by the control circuit 41.

In the example shown, the connector 520*f* in this case is maintained at zero voltage. The connector 520*g* and 520*h* in this case allows local control of the interface 55 to be provided in the event of the failure of the module 4. By way of a variation, they can be omitted.

The other connectors can have other functions, some of them can be inactive in some embodiments.

Other embodiments are nevertheless possible, in which the number and the function of the connectors 520 of the interface 500 differs depending on the functionality of the electrical equipment on board the removable element.

By virtue of this arrangement, when the removable element is received in one of the housings 471, the tongues 475 provide a separation between the connectors 520, which provides electric insulation between these connectors. Furthermore, their offset arrangement allows the neighbouring contacts to be sufficiently spaced apart to provide electric insulation despite the limited space on the interface 500.

Advantageously, as shown in FIG. 3, the interface 500 comprises an end edge 518 that blocks the end of the recesses 512 in the vicinity of the front face 501. This prevents a user from being able to access the connectors 520 from the front face of the device 1 when the removable element 5*a*, 5*b*, 5*c* and 5*d* is connected to the second module 4.

The modular construction of the device 1 allows easy replacement of part of the device 1, for example, to perform maintenance operations, without affecting the other components of the device 1. It also allows part of the components to be replaced, for example, in order to replace them with new components with improved functionalities in order to update the device 1, whilst preserving the other components that do not need to be replaced.

Furthermore, housing the distribution circuit 40 in the second module 4 provides greater operating flexibility for the removable elements 5*a*, 5*b*, 5*c* and 5*d*.

The previously described contactor 35 in this case is intended to be controlled in the event of the failure of one of the contactors 51, particularly when a contactor 51 does not open when it has received a control signal commanding it to switch to the open position.

This contactor 35 comprises separable contacts, the operation of which is similar to that of the contactors 51, except that it acts on the first power line 30 and thus causes the interruption of the electric current towards all the power lines when it switches to its open position.

The control circuit 41 is, for example, programmed to send a close or open control signal for the contactor 35 in such a case, by means of the data link 36.

Preferably, the contactor 35 is housed inside the arc extinguishing chamber of the circuit breaker 31, which avoids having to use two distinct extinguishing chambers and thus simplifies the design of the device 1.

This contactor 35 thus provides redundancy for the contactors 51, in a simpler and less expensive way than by adding an additional contactor for each of the second power lines. This contactor 35 nevertheless can be omitted, particularly when the removable elements 5*a*, 5*b*, 5*c* and 5*d* do not contain a contactor 51.

Figure 4:
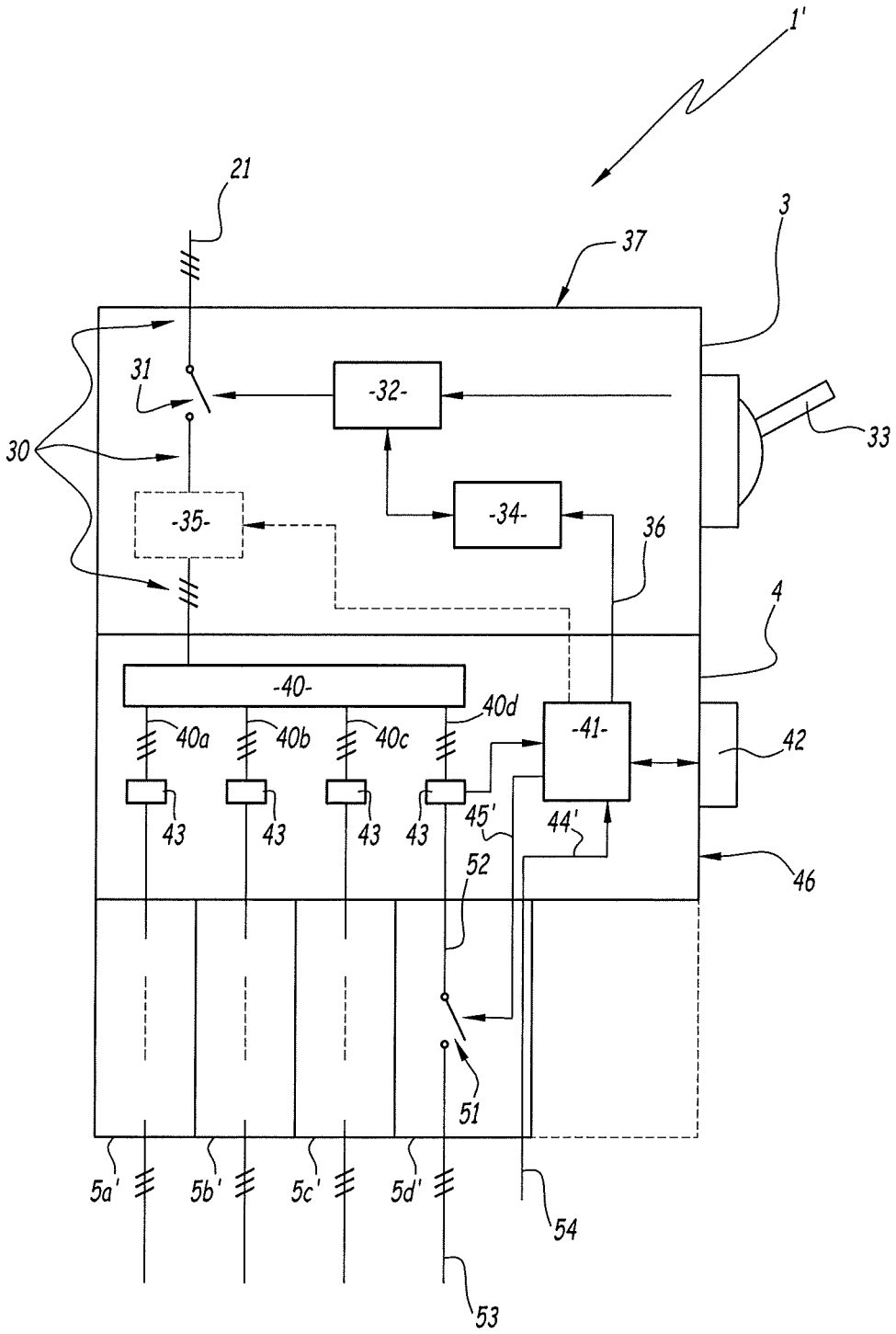
FIG. 4 is a block diagram of an electrical device according to another embodiment of the invention.

FIG. 4 shows an electrical device 1' according to a second embodiment of the invention. The elements of the device 1' that are similar to the device 1 of the first embodiment use the same reference numerals and are not described in detail, to the extent that the aforementioned description can be interchanged therewith.

The device 1' particularly differs from the device 1 with respect to how the removable elements are controlled by the control circuit 41. These removable elements in this case are referenced 5*a*', 5*b*', 5*c*' and 5*d*' and respectively replace the removable elements 5*a*, 5*b*, 5*c* and 5*d*.

More specifically, inside the device 1', the data bus 44 is omitted. Each removable element 5*a*', 5*b*', 5*c*' and 5*d*' comprises a data input terminal 54, intended to receive a control order and, for example, arranged in the connection zone of each removable element 5*a*', 5*b*', 5*c*' and 5*d*'. The terminal 54 is connected to the control circuit 41 via a data uplink 44' formed by connecting a first link part borne by the removable element and a second link part borne by the module 4, these link parts being connected together via connectors 520 when the removable element is received in the housing 471 in the assembled position. Similarly, the control interface for the actuator is connected to the control circuit 41 via a data downlink 45' that replaces the data link 45. This link 45' is constructed, for example, in a similar manner to the data link 45. Aside from these differences, the operation of the removable elements 5*a*', 5*b*', 5*c*' and 5*d*' is similar to that of the removable elements 5*a*, 5*b*, 5*c* and 5*d*.

Thus, in this embodiment, unlike the first embodiment, the control order sent to the device 1' to control a removable element is transmitted via the input terminal 54 associated with this removable element, then travels towards the control circuit 41 via the data uplink 44'. In response, the control signal 41' generates a control order that is sent to the corresponding removable element via the data downlink 45'.

Figure 6:
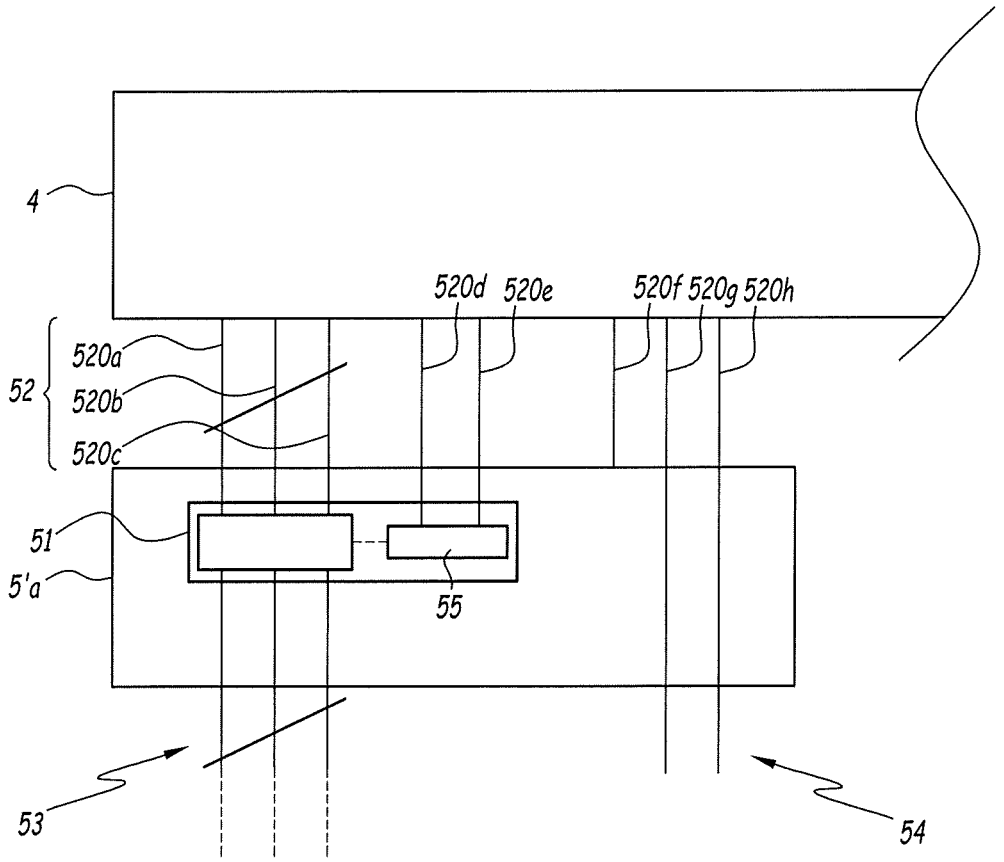

In this case, the role of some of the conductors 520 can differ. For example, as shown in FIG. 6, the connectors 520*g* and 520*h* in this case are used to transmit the control signal received from outside the removable element, by forming the data uplink 44'. The link 45' is, for its part, formed by virtue of the conductors 520*d*, 520*e* that are intended to be connected to the interface 55.

Other embodiments are possible. The number of removable elements 5*a*, 5*b*, 5*c* and 5*d* can differ. For example, there can be three or five or even two of these removable elements. The number of housings 471 of the interface 47 is then modified accordingly. In this case, the size of the removable elements and the housings 471 can be adapted accordingly. For example, when the device 1 is intended to receive only two removable elements, then the width L3 of the housings 471 can equal half the width L2.

The electrical equipment of the removable elements 5*a*, 5*b*, 5*c* and 5*d* can be equipment other than a contactor 51. For example, it can be a direction or rotation inverter. In this case, the corresponding removable element is not necessarily connected to the second power lines. Hence, it can occupy two housings 471. By way of a variation, it can be a data input/output module. The connectors 520 then can have a different function to the aforementioned function.

By way of an example, in the event that the electrical equipment is a source inverter, then the connector 520*d* is maintained at an electric potential of 24V, the connectors 520*e* and 520*f* respectively transmit the information originating from the conductors COM1 and COM2 of the data bus 44, and the connector 520*h* allows the routing of an identification signal that is transmitted by the source inverter and that allows the control circuit 41 to identify the source inverter.

Advantageously, the second module 4 comprises means for detecting the type of electrical equipment contained in the removable element 5*a*, 5*b*, 5*c*, 5*d*. These detection means can be of the mechanical or electrical type.

The mechanical type of detection means comprise, for example, a mechanical feeler that is arranged in the interface 47 and is adapted to cooperate with a matching shaped component placed on the interface 500 and to move along a predefined route under the action of this component when a movable element is inserted into the housing 471.

The electronic type of detection means comprise, for example, means for receiving and/or reading a predefined identification signal. This identification signal is transmitted and/or stored by the corresponding removable element.

The embodiments and the variations contemplated above can be combined together in order to generate new embodiments.

The invention claimed is:

1. An electrical device for supplying electrical power to multiple power units, comprising:

a fixed support;

input terminals for receiving a polyphase electric current;

a first module comprising a first power line connected to the input terminals, said power line comprising an electrical circuit breaker;

a second removable module comprising:

second power lines connected to the first power line via an electrical distribution circuit configured to distribute the polyphase electric current from the first power line to each of the second power lines;

a control circuit programmed to trip the circuit breaker depending on values of the electric current that is flowing through the second power lines;

a connection interface provided with output connectors connected to the second power lines;

removable elements each containing an item of electrical equipment intended to be connected to an electrical power unit via output terminals of said removable elements, each removable element being movable between an assembled position, in which each removable element is connected to the connection interface, and a removed position, in which each removable element is removed from the connection interface, the electrical equipment being connected to one of the second power lines via the output connectors of the connection interface when the removable element is in the assembled position, the control circuit being connected to a control interface of the electrical equipment of each removable element via a data link by virtue of the connection interface in order to send a control signal to said electrical equipment.

2. The device according to claim 1, wherein the electrical equipment is a contactor with separable contacts adapted to selectively interrupt the flow of an electric current on the second power line to which it is connected.

3. The device according to claim 2, wherein the first module comprises an additional contactor connected to the first power line and adapted to be controlled by the control circuit.

4. The device according to claim 1, wherein the connection interface comprises housings each intended to receive a connection portion of one of the removable elements when said removable element is in the assembled position.

5. The device according to claim 1, wherein the second module is connected to a data bus and wherein the control circuit is programmed to send a control signal depending on control orders received from the data bus.

6. The device according to claim 1, wherein each removable element comprises a data input terminal for receiving a control order, said data input terminal being connected to a first link part, and in that the second module comprises a second link part connected to the control unit.

7. The device according to claim 1, wherein the connection portion of each removable element comprises connectors, the shape of which matches that of the output connectors and which are formed so as to project relative to the connection portion, the electrical connection between the electrical equipment and the corresponding second power unit being provided via said connectors.

8. The device according to claim 1, wherein the connection interface and the connection portion of each removable element comprises translation movement guidance devices with matching shapes in relation to each other in order to enable a translation movement of said removable element relative to the second module.

9. The device according to claim 1, wherein the electrical equipment is a direction or rotation inverter or a data input/output module.

10. The device according to claim 1, wherein the first module is removable.

* * * * *